US005502986A

United States Patent [19]

Matsuda et al.

[11] Patent Number: 5,502,986

[45] Date of Patent: Apr. 2, 1996

[54] KNIT SLIDE FASTENER

[75] Inventors: Yoshio Matsuda; Hidenobu Kato; Yoshito Ikeguchi, all of Toyama, Japan

[73] Assignee: YKK Corporation, Tokyo, Japan

[21] Appl. No.: 493,099

[22] Filed: Jun. 21, 1995

[51] Int. Cl.[6] ..... D04B 21/20; D04B 21/14; A44B 19/56

[52] U.S. Cl. ..... 66/193; 66/190; 66/192; 66/195; 24/392

[58] Field of Search ..... 66/190, 192, 193, 66/194, 195; 24/392, 393, 397, 398, 391

[56] References Cited

U.S. PATENT DOCUMENTS

| | | | |
|---|---|---|---|
| 3,996,773 | 12/1976 | Matsuda | 66/195 X |
| 4,051,579 | 10/1977 | Heimberger | 66/195 X |
| 4,075,874 | 2/1978 | Heimberger | 66/190 X |
| 4,135,555 | 1/1979 | Mausbach | 24/392 X |
| 4,137,733 | 2/1979 | Heimberger | 66/195 |
| 4,467,840 | 8/1984 | Tsubata | 24/392 X |

FOREIGN PATENT DOCUMENTS

| | | | |
|---|---|---|---|
| 2179222 | 11/1973 | France | 24/392 |
| 2114700 | 10/1972 | Germany | 66/193 |
| 2093873 | 9/1982 | United Kingdom | 66/193 |

*Primary Examiner*—John J. Calvert
*Attorney, Agent, or Firm*—Hill, Steadman & Simpson

[57] ABSTRACT

A knit slide fastener including a fastener tape composed of a warp-knit ground structure including chain stitches, and a row of continuous coupling elements knit into and along an element-supporting portion of the fastener tape as the fastener tape is knit, wherein a plurality of threads are knit into the element-supporting portion as binding chain stitches, so as to form a group of successive longitudinally interlocked needle loops appearing on the front side and arranged such that in every two adjacent courses, the preceding needle loop overlies an upper leg of one coupling element, and the succeeding needle loop is disposed in a space between the coupling element and an adjacent coupling element at a position close to the ground structure so as to bend or flex the preceding needle loop into an inverted U shape extending embracingly over the upper and lower legs of the coupling element. With this arrangement, the row of coupling elements can be firmly secured to the ground structure of the fastener tape with high dimensional stability, and can always retain a stable attachment posture to insure the functions required in the slide fastener.

4 Claims, 6 Drawing Sheets

KNIT SLIDE FASTENER

BACKGROUND OF THE INVENTION

1. Field of the Invention

The present invention relates to a knit slide fastener having a row of continuous coupling elements knit into and along an element-supporting portion of one longitudinal edge of a knit fastener tape as the fastener tape is knit.

2. Description of the Prior Art

A conventional knit slide fastener disclosed, for example, in Japanese Patent Publication No. 38-11673 includes a fastener tape knit with threads of chain stitches and laid-in weft threads and having a longitudinal edge portion into and along which a row of continuous coiled coupling elements formed from a nylon monofilament is knit. The nylon monofilament is laid transversely across the longitudinal tape edge portion and shaped into the row of coiled coupling elements knit successively in the chain stitches as the fastener tape is knit. Another known knit slide fastener disclosed in U.S. Pat. No. 5,035,125 includes a fastener tape knit with threads of chain stitches and a laid-in weft thread, and a row of continuous coupling elements formed from a plastic monofilament laid in and along one longitudinal edge portion of the fastener tape. In the longitudinal tape edge portion, the laid-in weft thread is interlaced with the chain stitches running along two wales to downwardly urge the upper and lower legs of the coupling elements, and also with the chain stitches running along a neighboring wale to downwardly urge the lower legs of the coupling elements.

The conventional knit slide fasteners previously described are of the type including a fastener tape knit with threads of chain stitches and laid-in weft threads, and a plastic monofilament laid into one longitudinal edge portion of the fastener tape so as to form a row of continuous coiled coupling elements knit into and along the longitudinal tape edge portion. In the first-mentioned knit slide fastener, the row of coupling elements is secured by sinker loops of the chain stitches provided to form a ground structure of the fastener tape. Since the chain stitches are longitudinally stretchable, the row of coupling elements thus attached is dimensionally instable and is likely to be deformed when the chain stitches are stretched. The row of coupling elements thus deformed does not insure a smooth interlocking engagement with a mating row of coupling elements. In the second-mentioned knit slide fastener, needle loops of the chain stitches are merely interlaced with the laid-in weft thread extending transversely across the longitudinal tape edge portion, and the chain stitches urging the legs of the coupling elements downwardly also consist the ground structure. The chain stitches thus arranged are also readily stretchable in the longitudinal direction and hence cannot secure the coupling elements with sufficient dimensional stability. A smooth interlocking engagement between the opposed rows of coupling elements is, therefore, difficult to achieve.

SUMMARY OF THE INVENTION

With the foregoing drawbacks of the prior art in view, it is an object of the present invention to provide a knit slide fastener having a row of continuous coupling elements which is firmly secured to one longitudinal edge portion of a knit tape with high dimensional stability and in close contact with the ground structure to keep a stable attachment position at all times, thus maintaining the necessary functions as a slide fastener without causing accidental chain rupture during use of the slide fastener.

To attain the forgoing object, there is provided according to one aspect of the present invention a knit slide fastener including a fastener tape composed of a warp-knit ground structure and having an element-supporting portion along one longitudinal edge thereof, and a row of continuous coupling elements knit into and along the element-supporting portion of the fastener tape as the fastener tape is knit, each of the coupling elements having a pair of upper and lower legs. The improvement of the knit slide fastener comprises that the slide fastener has a plurality of parallel juxtaposed threads knit into the element-supporting portion as binding chain stitches, each of the binding chain-stitch threads including a succession of sinker loops forming a portion of the ground structure for supporting and securing the row of continuous coupling elements, and a succession of needle loops forming a group of successive, longitudinally interlocked needle loops, the group of needle loops being arranged such that in every two adjacent courses, the preceding needle loop overlies the upper leg of one of the coupling elements, and the succeeding needle loop is disposed in a space between said one coupling element and an adjacent coupling element at a position close to the ground structure so as to bend the preceding needle loop into an inverted U shape extending embracingly over the upper and lower legs of the coupling element.

According to another aspect of the present invention, there is provided a knit slide fastener including a fastener tape composed of a warp-knit ground structure and having an element-supporting portion along one longitudinal edge thereof, and a row of continuous coupling elements knit into and along the element-supporting portion of the fastener tape as the fastener tape is knit, each of the coupling elements having a pair of upper and lower legs. The improvement of the knit slider fastener comprises that the slide fastener has a plurality of parallel juxtaposed threads knit into the element-supporting portion as binding chain stitches of a double-knit structure, each of the binding chain-stitch threads including a group of successive, longitudinally interlocked lower needle loops forming a portion of the ground structure for supporting and securing the row of continuous coupling elements, and a group of successive, longitudinally interlocked upper needle loops arranged such that in every two adjacent courses, the preceding needle loop overlies the upper leg of one of the coupling elements, and the succeeding needle loop is disposed in a space between said one coupling element and an adjacent coupling element at a position close to the ground structure so as to bend the preceding needle loop into an inverted U shape extending embracingly over the upper and lower legs of the coupling element.

It is preferable that the element-supporting portion further includes at least one thread knit as tricot stitches and having a succession of sinker loops each extending over the upper leg of a corresponding one of the coupling elements.

Each of the coupling elements is knit into the ground structure in such a manner that the preceding needle loop of each binding chain-stitch thread is bent into an inverted U shape extending embracingly over the upper and lower legs of the coupling element. The coupling elements thus knit are held stable in position and in close contact with the ground structure while the upper and lower legs of the coupling elements are kept in a direction perpendicular to the front surface of the ground structure. Since the succeeding needle loop is interlocked with the preceding needle loop and pulled toward the ground structure, a single stitch is disposed between each space defined between two adjacent ones of the coupling elements, and the needle loops of the binding chain-stitch threads are tightly pulled toward the ground structure. As a result, the coupling elements are kept in a stable mounting condition and hence can always retain a smooth coupling operation as required in a slide fastener. Due to a presence of a recessed portion or space defined between each pair of adjacent coupling elements, the row of coupling elements can readily be bent in the longitudinal direction. With this improved flexibility, the row of coupling elements can be neatly attached to a flexible material, such as a garment fabric.

In the case where the binding tricot-stitch thread is used in combination with the binding chain-stitch threads and disposed on an upper surface of the row of coupling elements, the binding tricot-stitch thread protects the binding chain-stitch threads against lateral displacement. Furthermore, the binding tricot-stitch thread extending over the upper surface of the row of coupling elements can effectively prevent an accidental chain rupture which may occur when a pair of interengaged rows of coupling elements is subjected to an external force applied in a direction perpendicular to a general plane of the slide fastener. In this instance, the binding chain-stitch threads for anchoring the row of coupling elements and the binding tricot-stitch thread, if necessary, are preferably composed of threads having a thickness and a heat-shrinkability that are greater than those of the knitting threads used to form the fastener tape. The use of the thick and highly heat-shrinkable threads is particularly advantageous in that when a completed fastener is subjected to a heat setting process, these threads are thermally shrunk to fasten the coupling elements more tightly to thereby improve dimensional stability of the coupling elements while keeping a highly stable posture, and it results in smooth coupling operation of the coupling elements.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
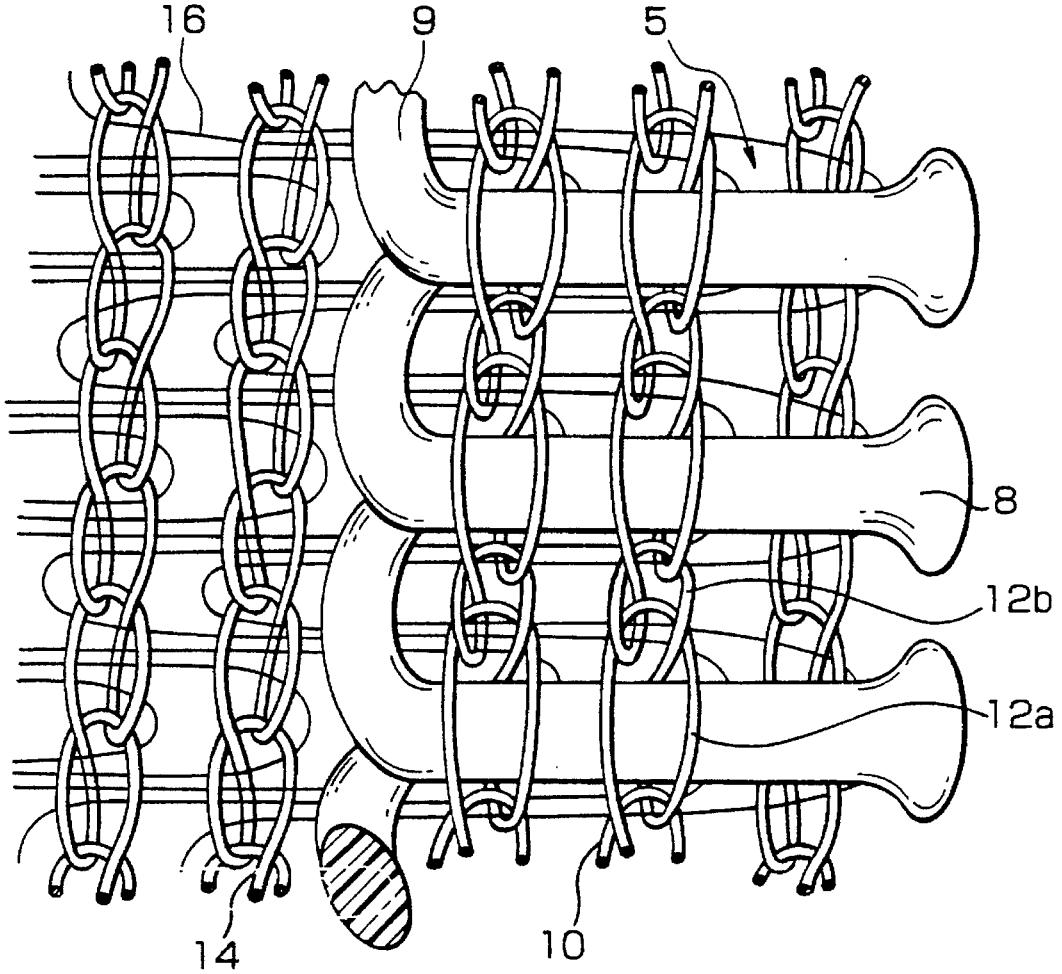
FIG. 1 is a diagrammatical fragmentary plan view of a knit slide fastener according to a first embodiment of the present invention, showing the manner in which a row of continuous coupling elements is attached.

Certain preferred embodiments of the present invention will be described below in greater detail with reference to the accompanying drawings. Referring now to FIG. 1, there is shown a knit slide fastener according to a first embodiment of the present invention.

The knit slide fastener (hereinafter simply referred to as "fastener") is knit on a warp-knit machine of the general type having a single needle bed. A ground structure of a warp-knit fastener tape 1 of the fastener except an element-supporting portion 2 extending along one longitudinal edge of the fastener tape 1 is composed of a plurality of threads 14 knit as chain stitches having a pattern of 1-0/0-1, as shown in FIG. 4(C), a plurality of threads 15 knit as tricot stitches having a pattern of 1-2/1-0, as shown in FIG. 4(D), and a plurality of laid-in weft threads 16 laid in a zigzag pattern of 0-0/4-4 and each extending across four adjacent wales 3, as shown in FIG. 4(E). The laid-in weft threads 16 may be replaced by single laid-in weft thread extending zigzag in every course across all the wales 3 of the fastener tape 1. Two adjacent ones of the wales 3 which extend along the longitudinal edge portion of the fastener tape 1 form the element-supporting portion 2 to which a row of continuous helically coiled coupling elements 5 is attached. The row of coiled coupling elements 5 is formed by reciprocating a monofilament crosswise in every other course 4 across the element-supporting portion 2. The row of coiled coupling elements 5 is knit into the element-supporting portion 2 as the fastener tape 1 is knit. Upper legs 6 of the respective coupling elements 5 are restrained by two threads 10 which are knit as binding chain stitches having a pattern of 1-0/0-1, as shown in FIG. 4(A), and extend along aforesaid two wales 3 of the element-supporting portion 2.

Figure 2:
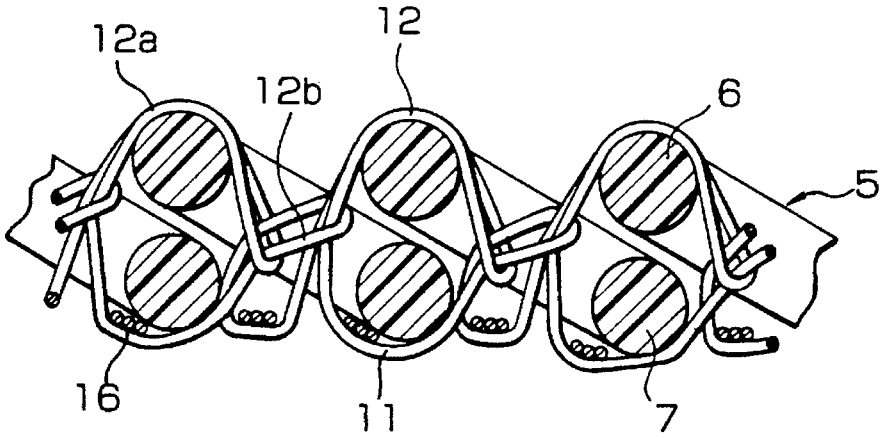
FIG. 2 is a longitudinal cross-sectional view of the slide fastener of FIG. 1.

FIGS. 1 and 2 diagrammatically show the condition in the row of coiled coupling elements 5 is attached. In these figures, for better understanding, the tricot stitch threads 15 of the ground structure are omitted, the laid-in weft threads 16 are each illustrated by a single solid line, and each of the knitting threads is shown as being composed of a thin thread and forming a succession of loose stitches. Actually, the knitting thread is composed of either a thick thread or a thin thread which is selected properly in view of various functions as required in a knit slide fastener, and the stitches of the knitting threads are fine and each formed tightly. The same may be said of a second embodiment shown in FIGS. 5 and 6.

The row of continuous helically coiled coupling elements 5 which is attached to the element-supporting portion 2 of the fastener tape 1 is formed from a monofilament of synthetic resin, such as nylon or polyester. The monofilament has a series of longitudinally spaced flattened portions previously formed by stamping to be coupling heads 8 and connecting portions 9 of the coupling elements 5. The monofilament having such flattened portions is laid-in by reciprocating it in every other course 4 of the fastener tape 1 transversely across the element-supporting portion 2 while bending the monofilament at each of the flatted portions. The thus inlaid monofilament is shaped into a row of continuous helically coiled coupling elements 5 each having a coupling head 8, a pair of legs 6, 7 extending in a common direction from the coupling lead 8, and a connecting portion 9 remote from the coupling head 8 and interconnecting the upper leg 6 of one coupling element 5 and the lower leg 7 of the adjacent coupling element 5. The row of coupling elements 5 is secured to the fastener tape 1 by means of the binding chain-stitch threads 10 which are provided exclusively for this fastening purpose along aforesaid two wales 3 of the element-supporting portion 2. The binding chain-stitch threads 10 each have sinker loops 11 disposed on the ground structure side and interlaced with the laid-in weft threads 16 forming a portion of the ground structure of the element-supporting portion 2, so that the sinker loops 11 form a portion of the ground structure of the element-supporting portion 2 on which the row of coiled coupling elements 4 is mounted.

Each of the binding chain-stitch threads 10 has needle loops 12 which are disposed on an upper side opposite to the sinker loops 11. The needle loops 12 extend lengthwise in succession so as to form a group of successive, longitudinally interlocked needle loops, as shown in FIGS. 1 and 2. The group of needle loops 12 are arranged such that in every two adjacent courses 4, the preceding needle loop 12*a* overlies the upper leg 6 of one of the coupling elements 5, and the succeeding needle loop 12*b* is disposed in a space between the one coupling element 5 and an adjacent coupling element 5 and interlocked with the preceding needle loop 12*a* at a position near the ground structure, as shown in FIG. 2. With this arrangement, the succeeding needle loop 12*b* is pulled downwardly toward the ground structure to thereby bend the preceding needle loop 12*a* downwardly into an inverted U shape extending embracingly over the upper and lower legs 6, 7 of the coupling element 5, thus anchoring the row of coupling elements 5 to the ground structure. Owing to the stitches or loops disposed between the adjacent coupling elements 5, the needle loops 12 of each of the two binding chain-stitch threads 10 are pulled toward the ground structure with the result that the upper and lower legs 6, 7 of each coupling element 5 are held in superposed relation in a direction perpendicular to the ground structure and they are firmly attached to the ground structure with high positional stability. The row of coupling elements 5 thus attached can always retain the necessary function of a smooth interlocking engagement with the opposite row of coupling elements. Furthermore, due to the presence of a recessed portion or space defined between each pair of adjacent coupling elements 5, the row of coupling elements 5 is readily flexible in the longitudinal direction and, hence, can be attached neatly onto a garment fabric, for example.

Figure 3:
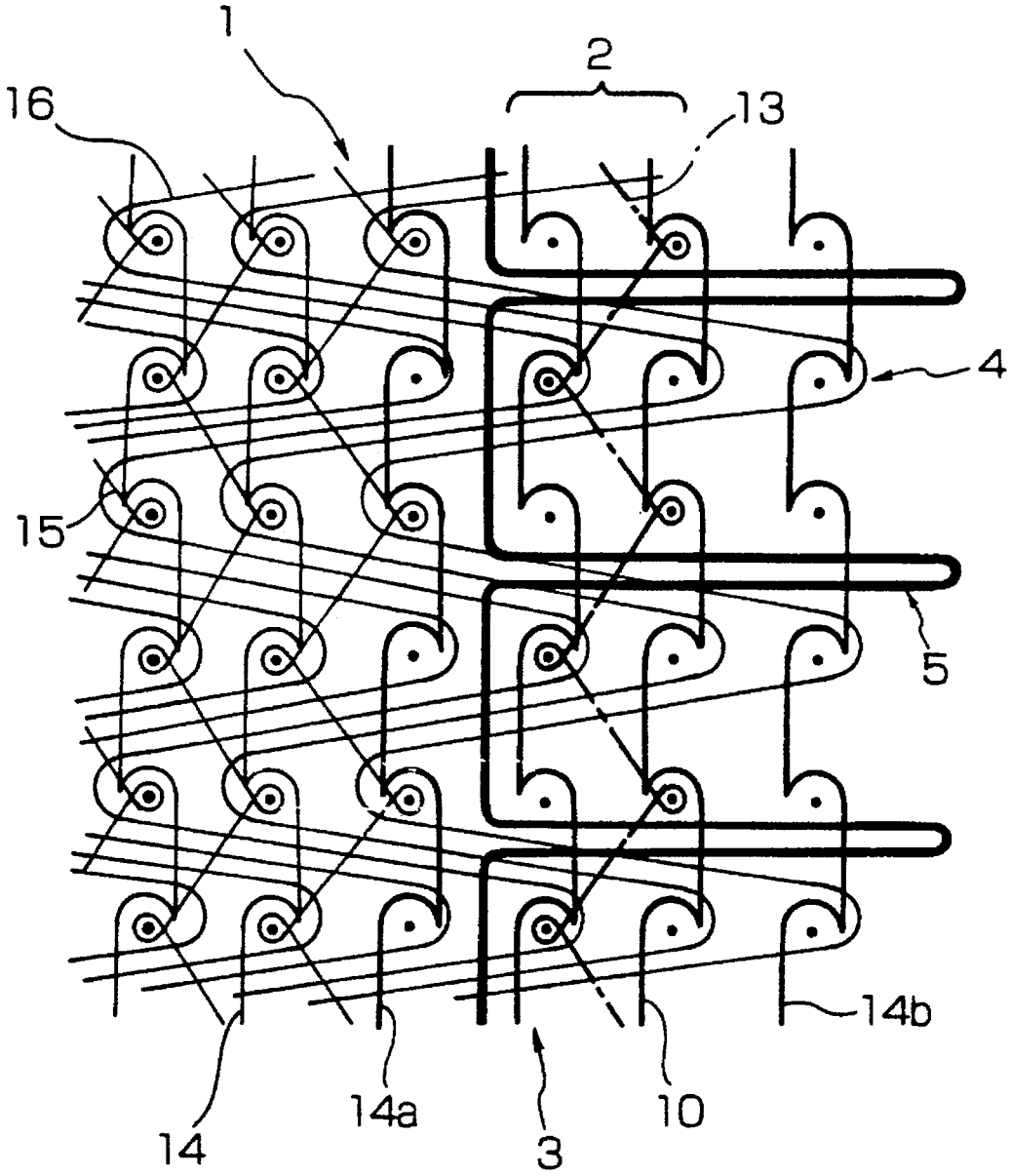
FIG. 3 is a point diagram of the slide fastener shown in FIG. 1.
Figure 4:
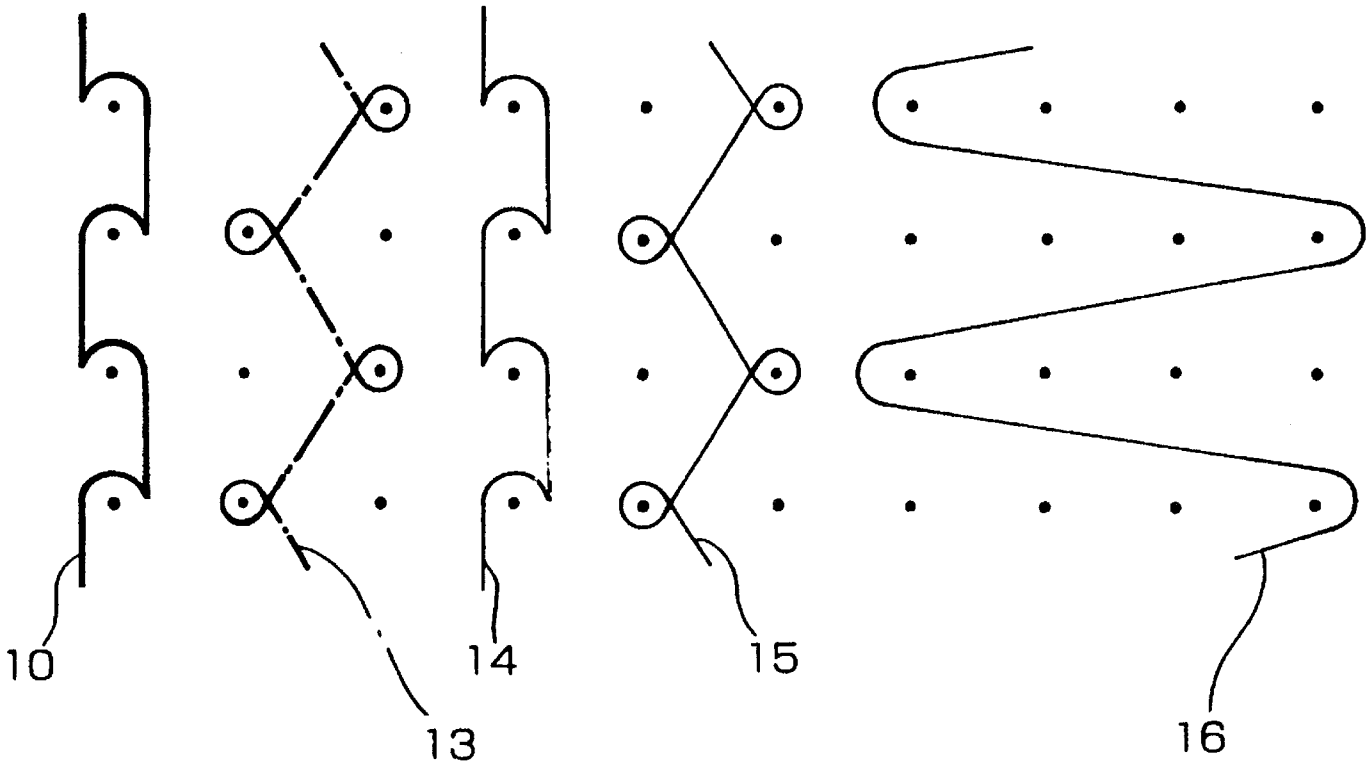
FIGS. 4(A)–4(E) are point diagrams showing the knitting patterns of various threads of FIG. 3.

FIGS. 3 and 4 illustrate, by the dot-and-dash line, thread 13 knit as binding tricot stitches having a pattern of 1-2/1-0, such as shown in FIG. 4(B), and provided in addition to the binding chain-stitch threads 10 along the aforesaid two wales 2 of the element-supporting portion 2. The binding tricot-stitch thread 13 may be provided on the upper surface of the row of coupling elements 5, if necessary. The binding tricot-stitch thread 13 is able to prevent transverse or crosswise displacement of the binding chain-stitch threads 10. Furthermore, by virtue of the binding tricot-stitch thread 13 provided over the upper surface of the row of coupling elements 5, the opposed rows of interengaged coupling elements 5, 5 are well protected against accidental rupturing which may occur when they are subjected to an external force applied in a direction perpendicular to a general plane of the slide fastener.

FIGS. 5–8 show a fastener according to a second embodiment of the present invention. The fastener of this embodiment is knit on a warp-knitting machine having two needle beds, such as a double Raschel loom. A ground structure of a warp-knit fastener tape 21 (FIG. 7) of the fastener except an element-supporting portion extending along one longitudinal edge of the fastener tape 21 is composed of a plurality of threads 34 knit as chain stitches having a pattern of 1-0/0-0/0-1/1-1, as shown in FIG. 8(C), a plurality of threads 35 knit as tricot stitches having a pattern of 1-2/1-1/1-0/1-1, as shown in FIG. 8(D), and a plurality of laid-in weft threads 36 laid in a zigzag pattern of 0-0/2-2/4-4/2-2 and each extending across four adjacent wales 23, as shown in FIG. 8(E), so as to withstand loads applied transversely of the fastener tape 21. The ground structure is knit on back needles of the warp-knitting machine. The laid-in waft threads 36 may be replaced by a single laid-in weft thread laid in every course 24 across all the wales 23 of the fastener tape 21 and extending zigzag in the longitudinal direction of the fastener tape 21.

Figure 7:
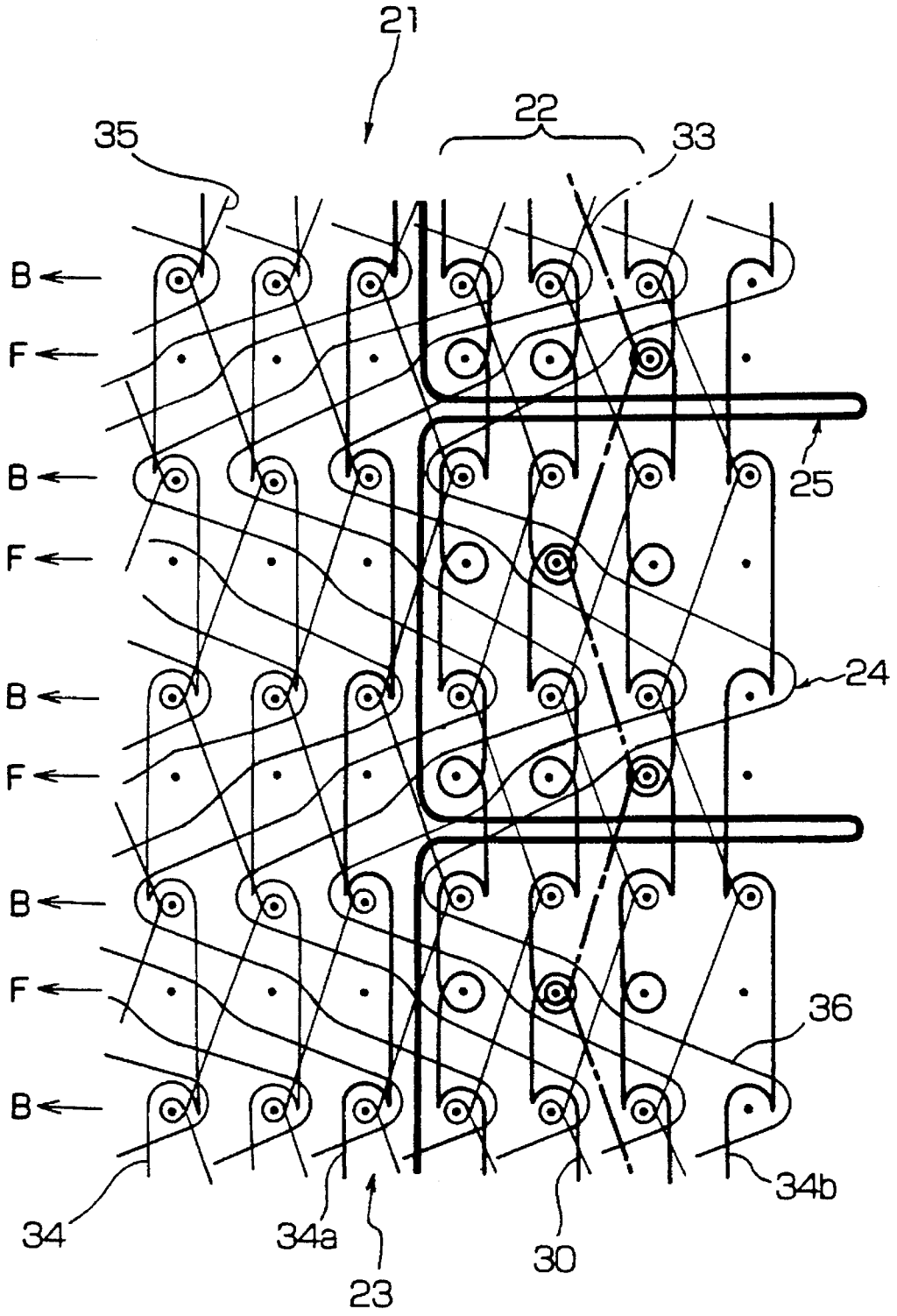
FIG. 7 is a point diagram of the slide fastener shown in FIG. 5.

Three adjacent wales 23 extending along the aforesaid one longitudinal edge portion of the fastener tape 21 form the element-supporting portion 22 to which a row of continuous helically coiled coupling elements 25 is attached. The row of coiled coupling elements 25 is formed by reciprocating a monofilament of synthetic resin, such as nylon or polyester, crosswise without changing its course in every four courses 24 across the element-supporting portion 22, as shown in FIG. 7. The row of coiled coupling elements 25 knit into the element-supporting portion 22 simultaneously with knitting of the fastener tape 21. Upper and lower legs 26, 27 of the respective coupling elements 25 are restrained by three threads 30 which are knit as binding chain stitches having a pattern of 0-1/1-0/1-0/0-1, such as shown in FIG. 8(A), and extend along aforesaid three adjacent wales 23 of the element-supporting portion 22. The ground structure of the element-supporting portion 22 has tricot-stitch threads 35 and laid-in weft threads 36 in the same manner as the other portion of the fastener tape 21.

Figure 5:
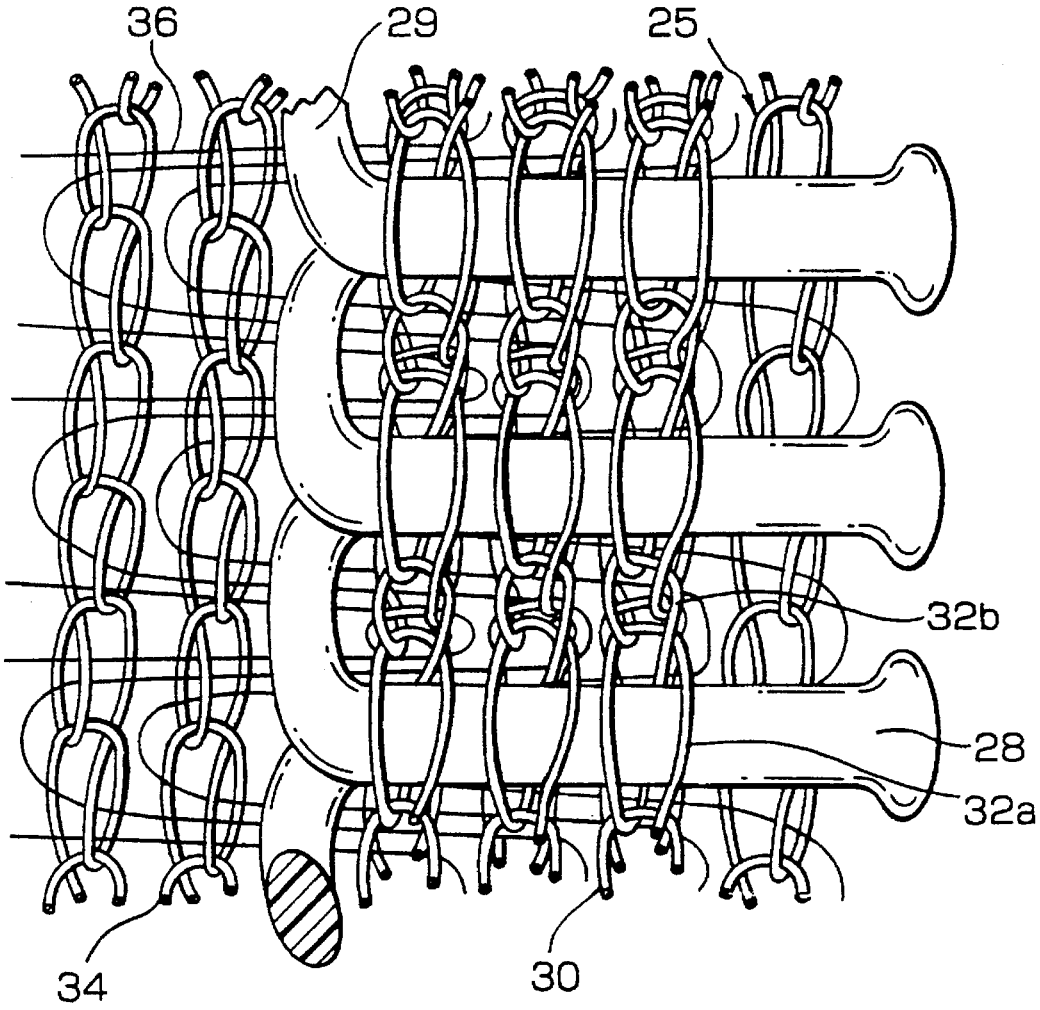
FIG. 5 is a diagrammatical fragmentary plan view of a slide fastener according to a second embodiment of the present invention, showing the manner in which a row of continuous coupling elements is attached.
Figure 6:
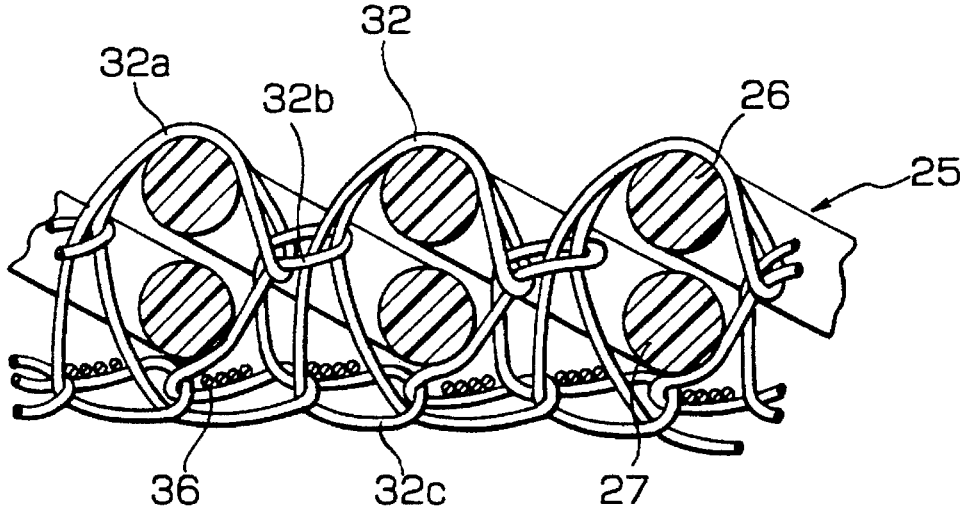
FIG. 6 is a longitudinal cross-sectional view of the slide fastener of FIG. 5.

More specifically, in the point diagram shown in FIG. 7, the needle position of front needles is designated by F, and the needle position of back needles is designated by B and arranged alternately with the front needle position with respect to each course. On front needles F, knitting threads form needle loops overlying the upper surface of the row of coiled coupling elements 25 while being knit in the fastener tape 1. In the illustrated embodiment, needle loops 32 of the three binding chain-stitch threads 30 knit as a double knit structure are formed on the front needle F at an attachment surface side of the element-supporting portion 22. Each of the needle loops 32 is interlaced with the succeeding needle loop formed on the front needles B, as shown in FIG. 5. By repeating this knitting procedure, three parallel juxtaposed lines of chain stitches are formed longitudinally on and along the upper surface of the row of coiled coupling elements 25 so as to secure the coupling elements 25 to the fastener tape 21, with their upper legs 26 forced downwardly toward the fastener tape 21, as shown in FIG. 5. Stated in further detail, the needle loops 32 of the three parallel juxtaposed binding chain-stitch threads 30, which are formed on the front needles F longitudinally on and along upper surface of the row of coiled coupling elements 25, are arranged such that as shown in FIGS. 5 and 6, in every two adjacent courses 24 (FIG. 7), the preceding needle loop 32*a* of each binding chain-stitch thread 30 overlies the upper leg 26 of one coupling element 25, and the succeeding needle loop 32*b* is disposed in a space between the one coupling element 25 and an adjacent coupling element 25 and interlocked with the preceding needle loop 32*a* at a position near the ground structure. With this arrangement, the preceding needle loop 32*b* is pulled downwardly toward the ground structure to thereby bend or flex the preceding needle loop 32*a* downwardly into an inverted U shape extending embracingly over the upper and lower legs 26, 27 of the coupling element 25, thus anchoring the row of coupling elements 25 to the ground structure. Owing to the stitches or loops disposed between the adjacent coupling elements 5, the needle loops 32 of each of the three binding chain-stitch threads 30 are pulled toward the ground structure with the result that the upper and lower legs 26, 27 of each coupling element 25 are held in superposed relation in a direction perpendicular to the ground structure and they are firmly attached to the ground structure with high positional stability. The row of coupling elements 25 thus attached always has the necessary function of a smooth interlocking engagement with the opposite row of coupling elements. Furthermore, due to the presence of a recessed portion or space defined between each adjacent pair of coupling elements 25, the row of coupling elements 25 is readily flexible in the longitudinal direction and, hence, can be attached neatly onto a garment fabric, for example.

Figure 8:
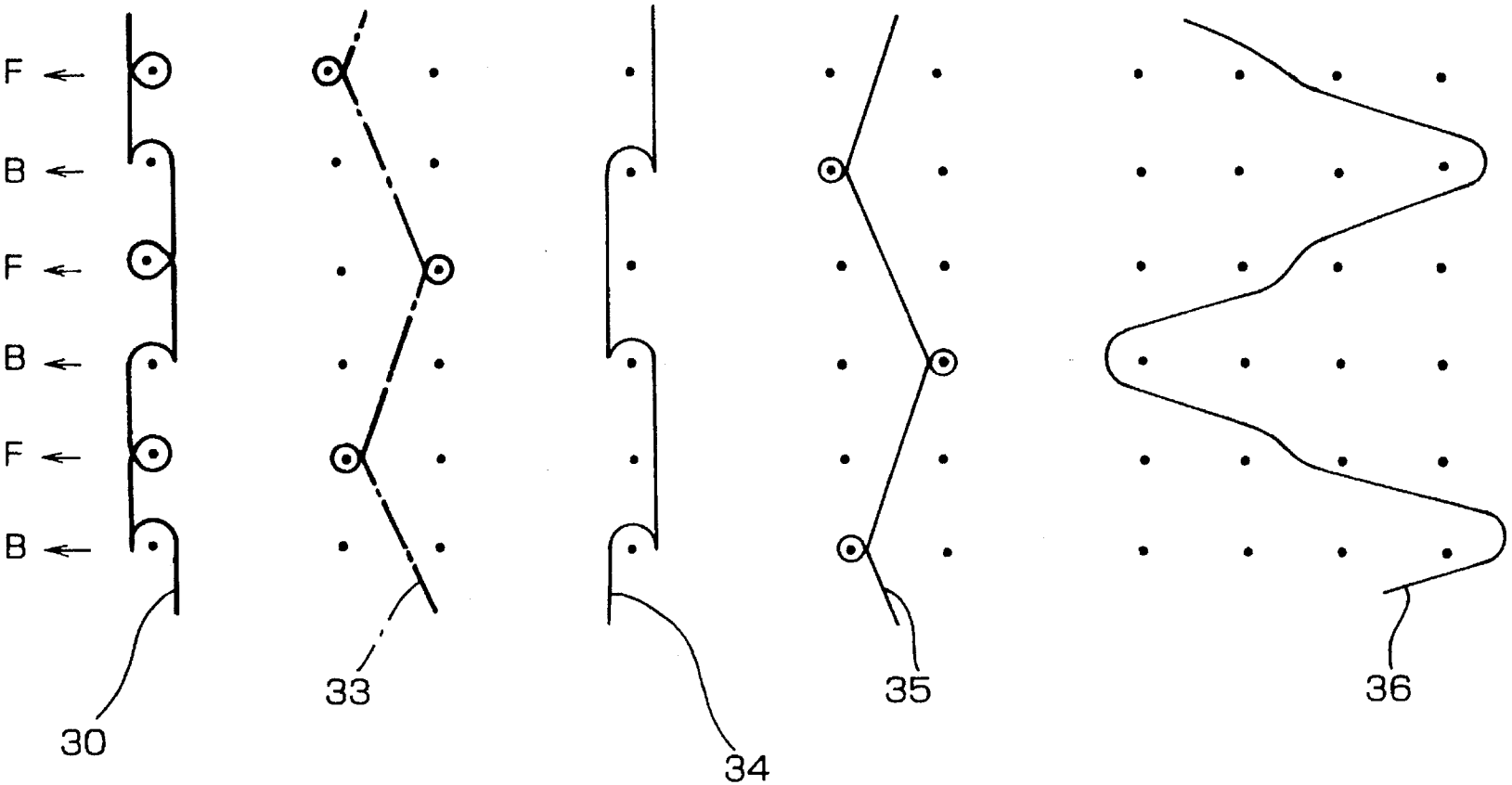
FIGS. 8(A)–8(E) are point diagrams showing the knitting patterns of various threads of FIG. 7.

FIGS. 7 and 8 illustrate, by the dot-and-dash line, a thread 33 knit as binding tricot stitches having a pattern of 1-1/1-2/1-1/1-0, as shown in FIG. 8(B). The binding tricot-stitch thread 33 is disposed on the upper surface of the row of coupling elements 25 at a position between stitches of two adjacent binding chain-stitch threads 30 adjacent to the coupling heads 28. The binding tricot-stitch thread 33 is used as occasion arises. Since the binding tricot-stitch thread 33 has a succession of sinker loops extending diagonally across and over the upper surface of the upper legs 26 of the coupling elements 25, it can attain the same advantageous effects as done by the binding tricot-stitch thread 13 in the first embodiment previously described. A similar binding tricot-stitch thread (not shown) may by added so that stitches of the three parallel adjacent binding chain-stitch threads 30 are interconnected by the binding tricot-stitch threads 33.

On the back needles B, the binding chain-stitch threads 30 are knit into the ground structure of the element-supporting portion 22 extending along one longitudinal edge of the fastener tape 21. In the illustrated embodiment, a tape portion of the fastener tape 21, which excludes the element-supporting portion 22, is knit with the chain-stitch threads 34, the tricot-stitch threads 35, and the laid-in weft threads 36. On the other hand, the ground structure of the element-supporting portion 22 of the fastener tape 21 is knit with the tricot-stitch threads 35 and the laid-in weft threads 36 and does not include the chain-stitch threads 34. As shown in FIG. 7, the binding chain-stitch threads 30 having a double knit structure include a succession of lower needle loops 32*c* interlaced with the needle loops of the tricot-stitch threads 35 to jointly form a fine knit structure.

As described above, according to the present invention, a row of continuous coupling elements 5; 25 is secured to a fastener tape 1; 21 by means of binding chain-stitch threads 10; 30 which extend embracingly over the upper and lower legs 6; 26, 7; 27 of each coupling element 5; 25 to align the upper and lower legs 6; 26, 7; 27 in a direction perpendicular to the front surface of the ground structure. With this arrangement, the row of coupling elements 5; 25 is knit closely into the ground structure in a stable condition. The binding chain-stitch threads 10; 30 and the binding tricot-stitch thread 13; 33, if necessary, that are used to secure the row of coupling elements 5; 25 may be composed of threads having a thickness and a heat-shrinkability which are greater than those of other knitting threads of the fastener tapes 1; 21. This is particularly advantageous in that when a finished fastener is subjected to a heat setting process, the thick and highly heat-shrinkable binding threads are thermally shrunk whereupon the row of coupling elements 5; 25 are fastened more tightly by the binding threads and secured firmly to the fastener tape 1; 21 with improved dimensional stability. Accordingly, the coupling elements 5; 25 can always retain a stable, displacement-free posture which will ensure a smooth coupling engagement between two opposed rows of coupling elements.

The number of the binding chain-stitch threads 10; 30 should by no means be limited to two and three as used in the illustrated embodiments but may include four or more. Rather, the number of the binding chain-stitch threads 10; 30 should preferably be determined depending on the size of the coupling elements 5;25 used. It is also preferable that two chain-stitch threads 14*b* and 14*a;* 34*b* and 34*a* extending respectively along an outermost wale 3; 23 of the element-supporting portion 2; 22 and a wale adjacent to the connecting portions 9; 29 and in the tape portion to consist the ground structure are composed of threads thicker than the other chain-stitch threads 14; 34 of the tape portion of the fastener tape 1; 21 for reinforcing the wales to retain the shape of the longitudinal tape edge portion.

The row of continuous coupling elements 5; 25 knit into the fastener tape 1; 21 as the latter is knit should by no means be limited to a row of helically coiled coupling elements but may include a row of continuous zigzag coupling elements (not shown) having upper and lower legs mounted astride one longitudinal tape edge. According to the present invention, the row of coiled coupling elements 5; 25 may also be used in a concealed slide fastener (not shown) in which instance the coupling elements 5; 25 are knit in an element-supporting portion extending along one longitudinal edge of a fastener tape, with the coupling heads 8; 28 directed toward a web portion of the fastener tape and the connecting portions 9; 29 directed toward the one longitudinal tape edge, and after that the element-supporting portion is bent or folded back under the web portion of the fastener tape.

It appears from the foregoing description that according to the present invention, a row of continuous coupling elements, which is knit into a fastener tape simultaneously with knitting of the fastener tape, is firmly secured in position by means of threads knit as binding chain stitches. The binding chain-stitch threads each have a group of successive, longitudinally interlocked needle loops arranged such that in every two adjacent courses, the preceding needle loop overlies the upper leg of one coupling element, and the succeeding needle loop is disposed in a space between the one coupling element and an adjacent coupling element and interlocked with the preceding needle loop at a position near the ground structure. With this arrangement, the preceding needle loop is bent or flexed into an inverted U shape extending embracingly over the upper leg and lower legs of the coupling element, so that each coupling element is held in close contact with the ground structure with its upper and lower legs forcibly aligned in a direction perpendicular to the front surface of the ground structure. Due to the presence of the stitches or loops disposed between the adjacent coupling elements, the row of coupling elements is able to retain its stable attachment condition and ensure a smooth coupling operation for a prolonged period of use. Furthermore, owing to the presence of a recessed portion or space formed between each adjacent pair of coupling elements, the row of coupling elements is readily flexible in the longitudinal direction and, hence, can be neatly attached to a garment fabric, for example.

Obviously, various minor changes and modifications of the present invention are possible in the light of the above teaching. It is therefore to be understood that within the scope of the appended claims the invention may be practiced otherwise than as specifically described.

What is claimed is:

1. A knit slide fastener including a fastener tape composed of a warp-knit ground structure and having an element-supporting portion along one longitudinal edge thereof, and a row of continuous coupling elements knit into and along the element-supporting portion of said fastener tape as said fastener tape is knit, each of said coupling elements having a pair of upper and lower legs, wherein the improvement comprises:

a plurality of parallel juxtaposed threads knit into said element-supporting portion as binding chain stitches, each of said binding chain-stitch threads including a succession of sinker loops forming a portion of said ground structure for supporting and securing the row of continuous coupling elements, and a succession of needle loops forming a group of successive, longitudinally interlocked needle loops, said group of needle loops being arranged such that in every two adjacent courses, the preceding needle loop overlies said upper leg of one of said coupling elements, and the succeeding needle loop is disposed in a space between said one coupling element and an adjacent coupling element at a position close to said ground structure so as to bend said preceding needle loop into an inverted U shape extending embracingly over said upper and lower legs of said one coupling element.

2. A knit slide fastener according to claim 1, wherein said element-supporting portion further includes at least one thread knit as binding tricot stitches and having a succession of sinker loops each extending over said upper leg of a corresponding one of said coupling elements.

3. A knit slide fastener including a fastener tape composed of a warp-knit ground structure and having an element-supporting portion along one longitudinal edge thereof, and a row of continuous coupling elements knit into and along the element-supporting portion of said fastener tape as said fastener tape is knit, each of said coupling elements having a pair of spaced upper and lower legs, wherein the improvement comprises:

a plurality of parallel juxtaposed threads knit into said element-supporting portion as binding chain stitches of a double-knit structure, each of said binding chain-stitch threads including a group of successive, longitudinally interlocked lower needle loops forming a portion of said ground structure for supporting and securing the row of continuous coupling elements, and a group of successive, longitudinally interlocked upper needle loops arranged such that in every two adjacent courses, the preceding needle loop overlies said upper leg of one of said coupling elements, and the succeeding needle loop is disposed in a space between said one coupling element and an adjacent coupling element at a position close to said ground structure so as to bend said preceding needle loop into an inverted U shape extending embracingly over said upper and lower legs of said one coupling element.

4. A knit slide fastener according to claim 3, wherein said element-supporting portion further includes at least one thread knit as tricot stitches and having a succession of sinker loops each extending over said upper leg of a corresponding one of said coupling elements.

* * * * *

UNITED STATES PATENT AND TRADEMARK OFFICE

CERTIFICATE OF CORRECTION

PATENT NO. : 5,502,986

DATED : April 2, 1996

INVENTOR(S) : Yoshio Matsuda, Hidenobu Kato, and Yoshito Ikeguchi

It is certified that error appears in the above-indentified patent and that said Letters Patent is hereby corrected as shown below:

On first page, left side column, after line 6, please insert:

--[30] Foreign Application Priority Data:
December 28, 1994 [JP] Japan . . . . . 6-340936.--

Signed and Sealed this

Twenty-second Day of April, 1997

Bruce Lehman

*Attest:*

BRUCE LEHMAN

*Commissioner of Patents and Trademarks*

*Attesting Officer*